US005102706A

United States Patent [19]

Latte

[11] Patent Number: 5,102,706

[45] Date of Patent: Apr. 7, 1992

[54] ASSEMBLY OF GLASS PIECES INTO TWO AND THREE DIMENSIONAL SHAPES

[76] Inventor: Richard C. Latte, 2017 Cameron St., Victoria, . CAX V8T 3M4

[21] Appl. No.: 563,466

[22] Filed: Aug. 7, 1990

[51] Int. Cl.[5] ..... B44F 1/06

[52] U.S. Cl. ..... 428/38; 156/63; 428/63

[58] Field of Search ..... 428/38, 63, 12, 413; 156/63, 98

[56] References Cited

U.S. PATENT DOCUMENTS

| | | | |
|---|---|---|---|
| 3,420,728 | 1/1969 | Haverstock | 428/38 |
| 3,420,730 | 1/1969 | Ellefson | 428/38 |
| 3,837,981 | 9/1974 | Flint | 428/375 X |
| 3,963,233 | 6/1976 | Worden | 269/289 R |
| 4,009,309 | 2/1977 | Holt | 428/38 |
| 4,110,393 | 8/1978 | Trame | 264/132 |
| 4,160,064 | 7/1979 | Nodiff | 428/40 X |
| 4,164,067 | 8/1979 | Brandt et al. | 29/619 X |
| 4,193,211 | 3/1980 | Dotsko | 428/43 X |
| 4,252,847 | 2/1981 | DelGrande | 428/38 |
| 4,289,233 | 9/1981 | Firth | 428/413 X |
| 4,318,946 | 3/1982 | Pavone | 428/34 |
| 4,352,843 | 10/1982 | Eckert | 428/38 X |
| 4,452,839 | 6/1984 | Worden | 428/38 |
| 4,495,739 | 1/1985 | Drennan | 428/38 X |
| 4,557,772 | 12/1985 | Crist, Jr. | 156/62 |

FOREIGN PATENT DOCUMENTS

| | | | |
|---|---|---|---|
| 1039136 | 8/1966 | United Kingdom | 156/63 |

OTHER PUBLICATIONS

The Technique of Stained Glass, published 1967 by Watson-Guptill Publications-Author: Patrick Reyntiens pp. 144-175.

*Primary Examiner*—Henry F. Epstein

*Attorney, Agent, or Firm*—Townsend and Townsend

[57] ABSTRACT

Substantially self supporting composites of glass pieces are made without having to cover the edges of the glass pieces with lead or copper tape that overlaps the sides of the glass pieces. The composites can be two or three dimensional assemblies. The method of making the composites comprises arranging a plurality of individual precut glass pieces with uncovered edges in a pattern with a flexible material adhering to surfaces of adjacent glass pieces, providing gaps between the glass pieces to expose edges of adjacent glass pieces, and applying a bonding agent in the gaps to rigidly bond the edges between the adjacent glass pieces but not to overlap onto the surfaces of the adjacent glass pieces.

20 Claims, 3 Drawing Sheets

ASSEMBLY OF GLASS PIECES INTO TWO AND THREE DIMENSIONAL SHAPES

BACKGROUND AND SUMMARY OF THE INVENTION

The present invention relates primarily to the preparation of stained glass assemblies, and more specifically to the assembly of glass pieces into substantially self supporting two and three dimensional composites.

The conventional preparation of stained glass composites such as windows, panels and other three dimensional assemblies, includes, first of all, pattern making and cutting the individual glass pieces, generally flat glass pieces and then treating each piece by covering each edge either generally by attaching a copper foil strip having an adhesive on one side or enclosing each glass piece with channel shaped lead came. The cover generally overlaps both surfaces of the glass.

For a two dimensional panel, the treated glass pieces are arranged on a paper pattern, called a cartoon, and either soldered together where the lead came pieces intersect or, in the case of copper foil, bead soldered along all seams. In either case, the soldered panel is then turned over and solder applied to the second side in a like manner. In addition, where lead came is used, glazier's cement is applied to both sides of all channels to strengthen and weatherproof the panel. Furthermore, it is often necessary to employ an additional "saddle bar" support system for both lead and copper foil panels.

For three dimensional composites using the copper foil technique, the treated glass pieces are usually assembled on a mostly horizontal sectional mold and the outside bead soldered. The soldered section is then removed from the mold and the inside bead soldered. To complete the composite, the sections are soldered together on both inside and outside. For three dimensional composites using lead came, the treated glass pieces are assembled and soldered in a flat position then bent and joined to form a horizontal layer. Successive horizontal layers are assembled in a like manner then placed vertically, one on top of the other, and soldered together to form multiplanar composites. Also, it is often necessary to employ additional support members of both lead and copper foil for making three dimensional composites.

In addition to the methods of making joints between glass pieces, U.S. Pat. No. 4,252,847 to DelGrande discloses an adhesive layer being applied to the edges of the glass pieces which overlaps both surfaces of the glass. Metallic particles are then coated on the adhesive layer before it solidifies. The treated glass pieces are then laid on a cartoon or mold and the solder applied to both sides of the coated adhesive layer to form the joint.

In the case of three dimensional composites such as Tiffany type lamp shades, terrariums, boxes, etc., the flat pieces of glass are first cut to size and in many cases are temporarily placed on the surface of a form. In one example Crist in U.S. Pat. No. 4,557,772 discloses the pieces being temporarily attached to the external surface of a form and then joining the edges of the glass pieces together. However, in order to attach the glass pieces together, each piece of glass has to be removed and the edges covered or foiled and replaced. The solder is then applied to join the foiled edges together.

I have now found that I can perpare two dimensional and three dimensional configurations made from glass pieces which do not require the edges of the glass pieces to be covered by the application of foil or lead, and do not require the application of solder. The glass pieces my be bonded together using a bonding agent on the edges in a single step, the bonding agent not overlapping the surfaces of the glass pieces.

In most cases where glass composites are prepared, it is necessary to leave the cover or joining material overlapping the surfaces of the glass pieces. The application of a lead came or copper foil often requires heat which can result in breakage of the glass. In the case of lead joints, the resulting joint is flexible and has no structural strength, so stress fractures can occur in the glass pieces both in the assembly process, where the glass pieces are turned over before completion, and over time as the supporting system permits movement. There is no truly rigid system.

By utilizing a flexible material having an adhesive surface I can assemble uncovered glass pieces with spaces or gaps between edges of adjoining pieces for insertion of a bonding agent into a two dimensional configuration. In a three dimensional configuration, no spaces or gaps need be left. provided the assembly occurs on a flat plane and then the flexible material is then bent at the joins to form a three dimensional shape. The bend causes a V-groove for the insertion of a bonding agent and the bonding agent only joins the glass edges. The join is stronger than the glass which avoids stress cracks occurring in the glass. To increase the adhesive quanties of the bonding agent, for items such as aquariums, the smooth edges of the glass pieces may be roughened.

By utilizing a bonding agent I have found that I can prepare two and three dimensional glass composites with the joins between glass pieces being in any position, that is to say either vertical or horizontal. The bonding agent is in a putty like form which does not run as in the case of liquid solder. Furthermore, when applying the bonding agent to temporarily joined composites, both inside and outside faces of all joins are made at the same time. Also, the bonding agent forms a permanently weatherproof, watertight and non toxic seal that will not oxidize of decompose. In addition, this bonding agent allows for construction of substantially larger composites without requiring an additional support system. This is made possible due to a significant increase in tensile strength and significant reduction in weight of the bonding agent compared to present day methods employing heavy metals. I have also found that three dimensional multiplanar composites can now be assembled on full size vertical molds in one step. Furthermore, the process enables me to repair two dimensional or three dimensional composites of glass pieces by cutting out a damaged piece and replacing it without having to disassemble the composite or remove the damaged piece from an installed location.

The present invention provides a method of constructing a substantially self supporting composite of separate glass pieces comprising the steps of arranging a plurality of individual precut glass pieces with uncovered edges in a pattern with flexible material adhering to surfaces of adjacent glass pieces; providing gaps between the glass pieces to expose edges of adjacent glass pieces, and applying a bonding agent in the gaps to rigidly bond the edges between the adjaecnt glass pieces but not overlap onto the surfaces of the adjacent glass pieces.

The process may be carried out on two dimensional and three dimensional composites. The flexible material, which may be a sheet or strip overlapping adjacent edges of the glass pieces, may remain or alternatively can be removed after the bonding agent has hardened. A metallic power or other composition may be added to the top of the bonding agent, or if desired adhesive lead tape may be applied over the bonding agent thus showing leaded glass construction.

BRIEF DESCRIPTION OF THE DRAWINGS

In drawings which illustrate embodiments of the present invention.

BRIEF DESCRIPTION OF THE PREFFERED EMBODIMENTS

Figure 1:
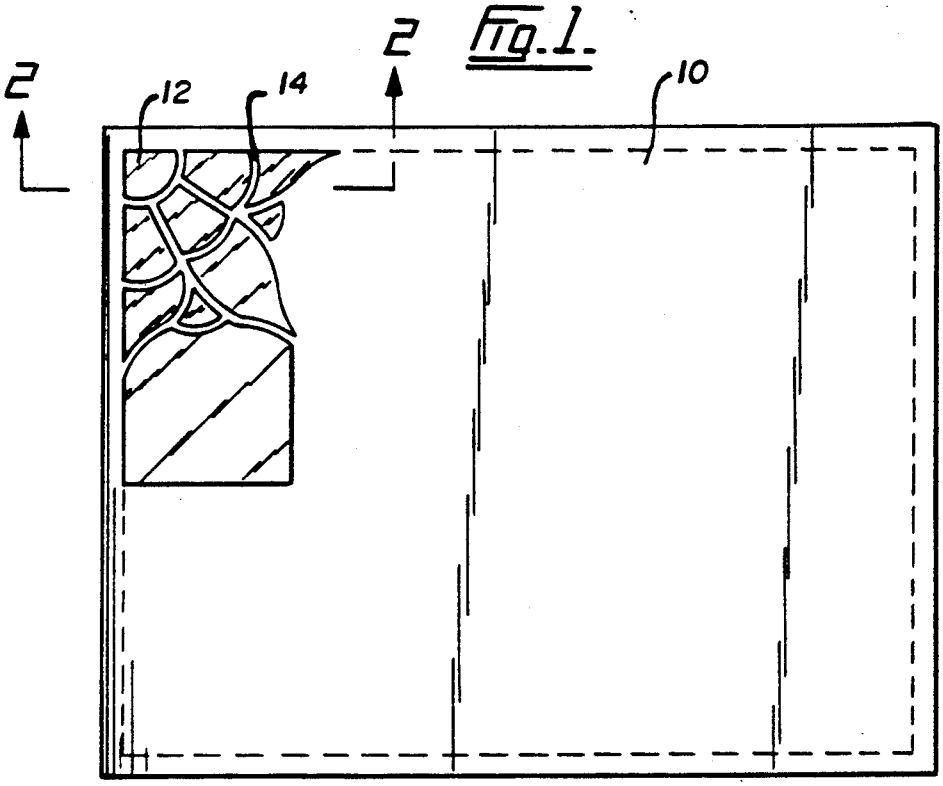
FIG. 1 is a plan view of a two dimensional panel composite of glass pieces assembled on a sheet of flexible material showing gaps between the pieces.

For the preparation of a composite comprising a plurality of glass pieces, flexible material in the form of a sheet or strips are required to which the glass pieces are attached by an adhesive. The flexible material may be transparent, or opaque and may contain images, designs, patterns, colors, textures, etc. The flexible material may be a paper, plastic or fabric and in some cases is removed and in other cases remains in place after the construction of the composite. The composite is initially assembled on the flexible material but the end product may be a two dimensional or a three dimensional substantially self supporting composite. The flexible material has to be sufficiently strong so as to prevent tearing but must be foldable if a three dimensional composite is to be made. FIG. 1 illustrates flexible material 10 laid out as a flat sheet of paper, fabric or plastic and has adhesive on one side. Glass pieces 12 that have been precut but have similarly prepared adjacent edges, not covered in any way, are placed on the sheet 10 and the adhesive ensures that the glass pieces 12 stick to the sheet 10. The edges of the glass pieces may be roughened if it is desired to have increased bonding between the bonding agent and the glass. Gaps 14 are provided between the glass pieces 12. The gap or seam is preferably in the range of about $\frac{1}{8}$ to $\frac{1}{4}$ inch wide for a two dimensional composite. For a three dimensional composite, the edges of the glass pieces may be touching so there is no space there between, and the flexible material bent, or a gap or about 1/32 to $\frac{1}{8}$ inch wide may be provided.

The bonding agent is a putty-like composition, and is preferably an epoxy resin. It is imperative that the bonding agent form a rigid joint. A silicon adhesive, which is flexible, does not form a self supporting composite. One suitable epoxy resin is sold under the trade mark "Marine-Tex". It handles like putty and comes in a white or grey color. The bonding agent 16 is placed in the gap or seam 14 and when it hardens, it bonds or fuses to the glass and provides a rigid connection between the glass pieces 12.

The bonding agent may have color tints or powdered metal, such as copper, brass, aluminum or the other suitable metal added to the bonding agent to provide a uniform tinted or metallic finish. Alternatively, an adhesive lead tape may be applied on top of the bonding agent or a metallic acrylic texturing compound may be placed on the bonding agent to cover the seam.

Figure 2:
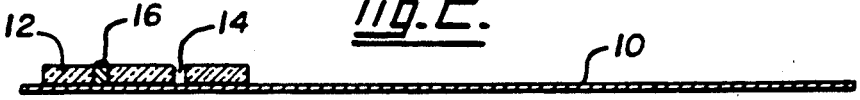
FIG. 2 is a partial section taken at line 2—2 of FIG. 1.

As shown in FIG. 2 the adjacent edges of glass pieces 12 and the sheet 10 form a gap 14. The bonding agent 16 is applied to the gap 14 from the open face in a grout like manner with the sheet 10 providing a stop for the bonding agent. Excess bonding agent left on the top surface of glass pieces 12 may be removed with a suitable thinner before the bonding agent has hardened. If the sheet 10 is removed after the bonding agent has hardened, a finish seam will be shown on both exposed surfaces of the filled gap 14. In FIG. 2 the bonding agent 16 is shown to have a slight crown. This may be omitted and the bonding agent made be flush with the glass pieces 12. It is preferred that the crown be omitted if an adhesive lead tape is to be applied to the seam.

The glass pieces 12 may be all different colors depending on the artistic mosaic required. Alternatively, the glass pieces may be one color or in another embodiment the pieces may be clear glass with an image design such as color pattern or texture on the flexible material which can be seen through the clear glass pieces.

The bonding agent, having a putty consistency can be applied to the seam or gap in either a horizontal or vertical plane. If necessary, the bonding agent can be applied from the underneath as the putty-like substance does not run like liquid solder, and retains it position. The joint provides a permanent weatherproof watertight and non-toxic seal between the individual pieces of glass and permanent anchors such as twist wires, hanging loops, hinge hardware, etc., may be inclined in the bonding agent for the particular design of composite and to support the composite.

Figure 3:
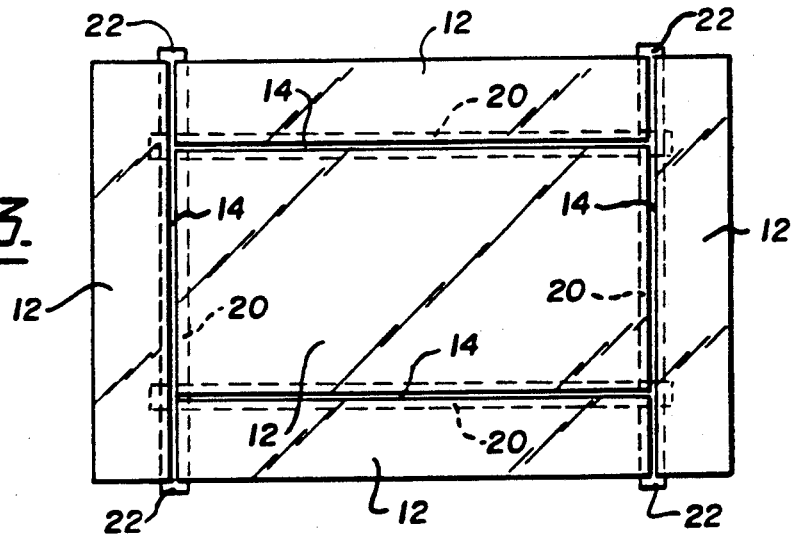
FIG. 3 is a plan view of a two dimensional panel composite of glass pieces assembled with strips of flexible material extending under gaps between the pieces.

FIG. 3 illustrates a plan view of glass pieces 12 that have no irregular or curved edges. arranged on a flat plane with gaps 14 provided between the glass pieces 12. Strips of the flexible material 20 are adhesively attached underneath the glass pieces 12 so as to both completely cover gaps 14 and also cover a marginal portion of all adjacent surfaces of glass pieces 12. The strips 20 may be allowed to extend beyond the composite to form end closing tabs 22. The end closing tabs 22 may be folded up over the outside edges of glass pieces 12 to close off the outside ends of gaps 14. The bonding agent is applied to gaps 14. Mounting and hanging hardware may be partially embedded into the bonding agent at midway point before the bonding agent has hardened.

Figure 4:
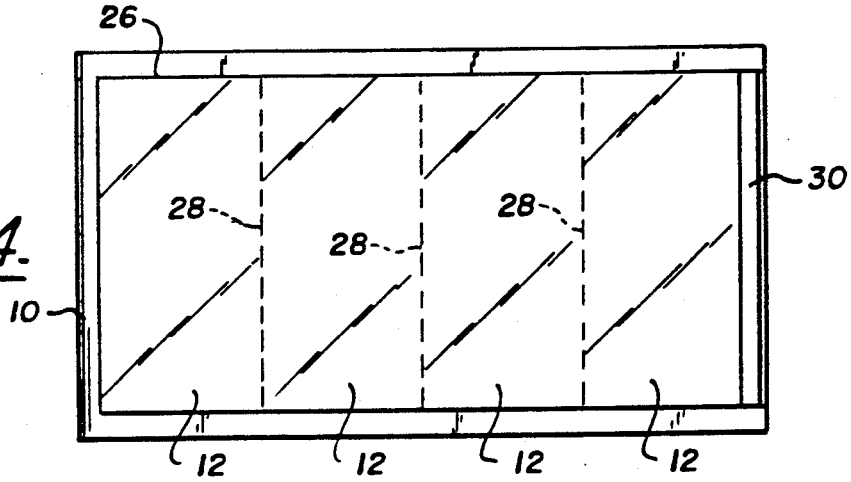
FIG. 4 is a plan view showing the lay out flat uncut glass on a sheet of flexible material with scored lines shown to mark the break lines.
Figure 5:
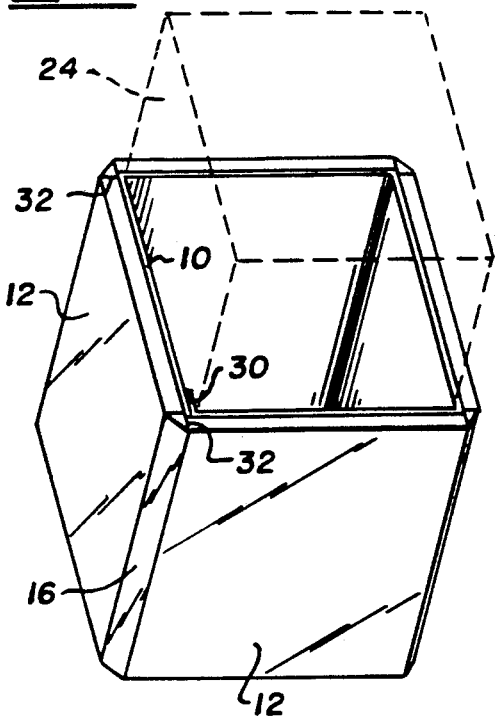
FIG. 5 is an isometric view showing an assembled three dimensional composite made from the glass panel shown in FIG. 4.

FIG. 4 is a plan view of a sheet of the flexible material 10 onto which is placed a flat panel of glass 26 which has been precut to a specific size and shape for forming into a three dimensional oblong. Excess flexible material 10 is trimmed off flush along three of the outside edges of glass panel 26. The sheet 10 is left to extend beyond the forth side glass panel 26 forming a closing seam strip 30. This strip 30 is preferably between ¼ and ½ inch wide. Scribe lines 28 are shown dividing glass panel 26 into four glass pieces 12. After scribe lines 28 have been scored onto the glass panel 26, then the glass is broken along the scribe lines 28 to form different glass pieces 12 that are ready for folding into a three dimensional shape with the sheet 10 on the inside holding the glass pieces 12 together. Because each of the pieces 12 is adhering to the sheet 10, it is now possible to fold the composite into its oblong shape as shown in FIG. 5. The composite is folded around a simple jig 24 which determines the finished shape of the composite. Closing seam strip 30 is adhesively attached to the sheet 10 on the glass piece 12 to form the closing seam. Where the sheet 10 has been folded. V-grooves 32 are formed, and the bonding agent 16 is then placed in the V-grooves 32. The bonding agent is allowed to harden and one has a four sided parallelogram shaped column which contains the sheet 10. The sheet 10 may be clear plastic and clear glass used for the composite and would therefore not be visible, or the sheet 10 may have pattern thereon. Alternatively the composite may be made of opaque glass. If desired the sheet 10 may be saturated with an adhesive releasing solution and removed.

The embodiment described above provides for the breaking or cutting of the glass after it has been placed on a sheet of the flexible material and scribed. The space or gap between the edges of the glass pieces is substantially eliminated if the edges are touching, the gap opens up into a V-groove when the glass pieces are bent with the flexible material forming a hinge. This embodiment relates only to three dimensional composites where all scribe lines are perfectly straight.

Figure 7:
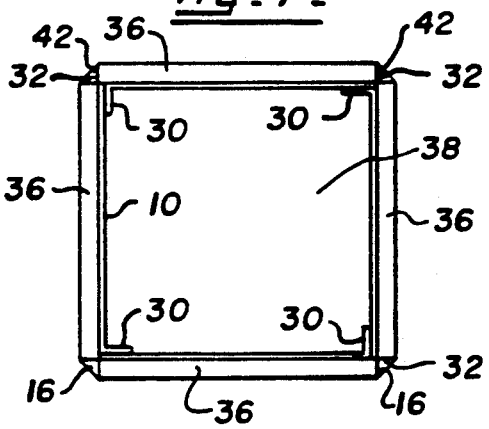
FIG. 7 is a plan view showing the assembled composite made from precut glass pieces shown in FIG. 6.
Figure 6:
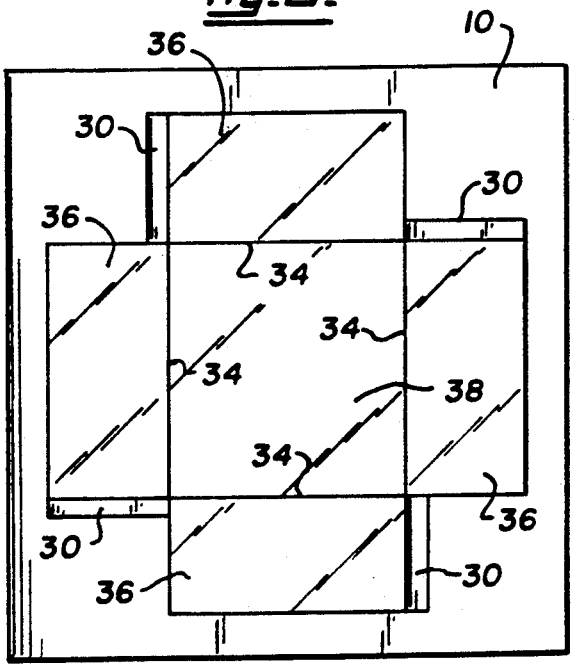
FIG. 6 is a plan view showing a plurality of precut glass pieces assembled on a sheet of the flexible material prior to forming into a three dimensional composite according to another embodiment.

FIG. 6 shows a plan view of a plurality of uncovered precut glass pieces arranged on the adhesive surface of a sheet of flexible material 10 in a flat plane prior to folding into a three dimensional box. Center glass piece 38 is first placed on the sheet 10 with glass pieces 36 arranged around the perimeter of center glass pieces 38 and the adjacent edges of center glass piece 38 and glass pieces 36 touching at 34. The sheet 10 is then trimmed flush to two of the outside edges of glass pieces 36 but is left to extend beyond the third side of glass pieces 36 forming closing seam strips 30. The composite is then folded along lines 34 with the sheet 10 acting as a hinge. The seam closing strips 30 are adhesively attached to the sheet 10 forming corners as shown in FIG. 7 thus creating a three dimensional box with center glass piece 38 being the bottom and glass pieces 36 forming the sides and with the sheet 10 still remaining in the center. Where the glass pieces 36 have folded along lines 34 are joined at corners, V-grooves 32 are formed and the bonding agent 16 placed in gaps 32. If desired hinge hardware for separate top piece may be embedded into the bonding agent at points 42 before the bonding agent has hardened.

Figure 8:
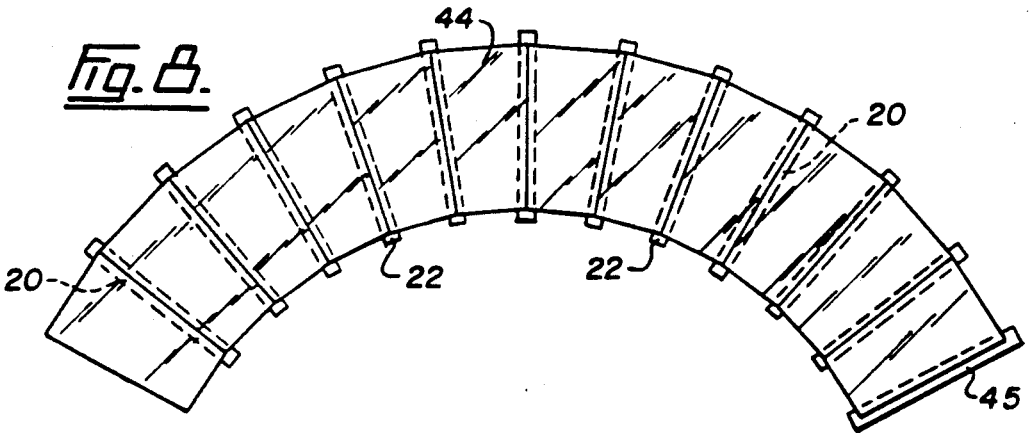
FIG. 8 is a plan view showing a plurality of precut glass pieces assembled with strips of the flexible material prior to forming into a three dimensional composite according to a further embodiment.
Figure 9:
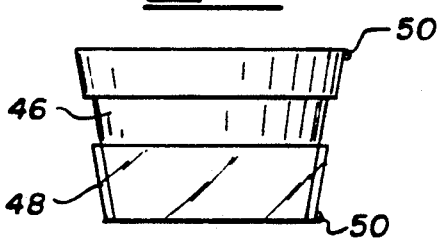
FIG. 9 is a side view showing a plant pot around which the temporarily joined glass pieces shown in FIG. 8 are wrapped prior to being formed into the three dimensional composite.

Another embodiment is illustrated in FIG. 8 wherein a number of uncovered precut glass pieces 44 are laid out in a flat plane with adjacent edges touching and are joined with strips of the flexible material 20. One strip 45 is attached to extend beyond the composite to form closing seam strip 45. All strips 20 have end closing tabs 22 extending beyond the composite. The composite is then folded into a shell which in turn is used to fit over a plant pot 46 shown in FIG. 9 with a plastic liner 48 surrounding the plant pot 46. The dimensional of the glass pieces 44 are calculated to suit each particular dimension of plant pot. The glass pieces 44 are folded on strips 22, fitted to the plant pot 46 and liner 48, which acts as a form, the closing seam made with strip 45, and closing tabs 22 may be folded up over the outside edges of glass pieces 44, and the bonding agent placed in the V-groove between adjacent glass pieces 44. The plant pot and liner may be removed after the bonding agent has hardened. Alternatively, a bead of adhesive may be placed around the outside circumferences at the top of plant pot 46 and bottom of plastic liner 48 as shown at 50 to permanently join both pot and liner to the completed glass composite.

Figure 10:
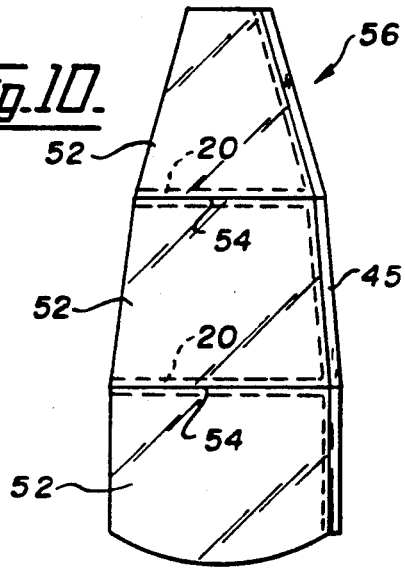
FIG. 10 is a plan view of glass pieces assembled with strips of the flexible material to form a vertical panel of a three dimensional multiplanar composite of a Tiffany type lamp.
Figure 11:
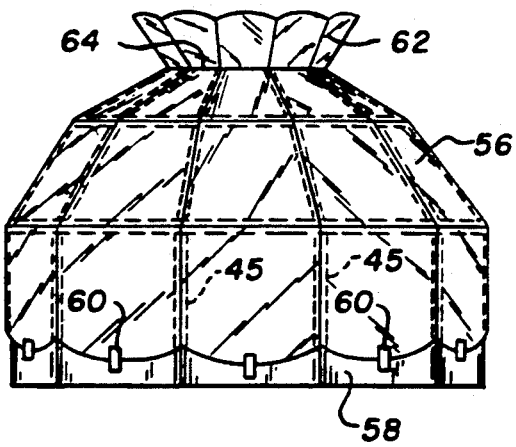
FIG. 11 is a side view of panels shown in FIG. 10 temporarily attached to a full size mold forming the Tiffany type lamp.

FIG. 10 is a plan view showing glass pieces 52 assembled on a flat plane to form a panel 56 with adjacent edges 54 touching and using strips of flexible material 20 with seam closing strips 45 running down one side to form a vertical panel for the multiplanar composite shown in FIG. 11. The assembled panels 56 are laid, one next to the other, over a full sized mold 58 and the panels 56 attached to mold 58 at top and bottom using adhesive tape 60. To make the final closing seam the panel 56 first attached to mold 58 is lifted slightly and the seam closing strips 45 on the last panel 56 inserted under the first panel. Both first and last vertical panels 56 are then attached to mold 58 using adhesive tape 60 and bonding agent is placed in all V-grooves formed at folds 54 and seams. When the bonding agent has hardened, tape 60 is removed and the composite removed from mold 58. If desired, a crown 62 may be assembled on a separate mold and the bonding agent applied. Both completed crown and body may be joined by applying clear silicon to the inside of join 64.

Figure 12:
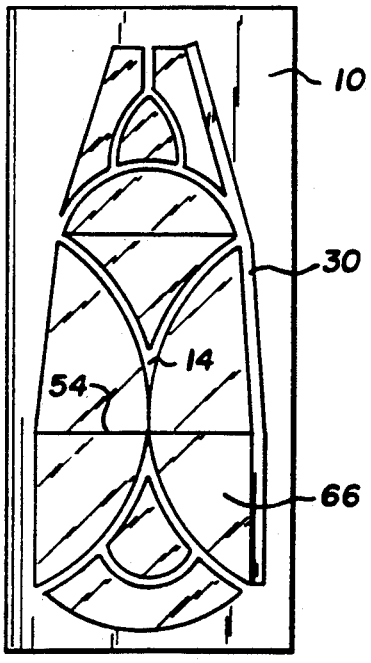
FIG. 12 is a plan view of glass pieces assembled on a sheet of the flexible material to form a variation of the vertical panel shown in FIG. 10.

FIG. 12 shows a plurality of uncovered glass pieces 66 each having at least one irregular or curved edge assembled on a flat sheet of flexible material 10 and allowing for a gap 14 between adjacent pieces except at 54 where the adjacent pieces 66 touch. Excess temporary sheet 10 is trimmed off along three sides of the assembled panel except at 30 which is left to form a seam closing strip. The panel is then assembled into a multiplanar composite as above described.

Figure 13:
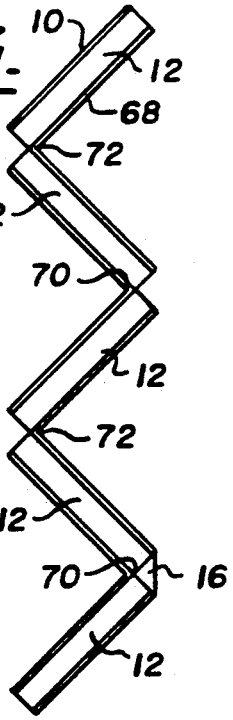
FIG. 13 shows a sectional view of glass pieces assembled with the temporary joining material on both sides and folded in two directions.

FIG. 13 illustrates an embodiment wherein separate glass pieces 12 have a first flexible material 10 on one side and a second flexible material 68 attached to the other side. Thus the glass pieces 12 have flexible material 10 and 68 on both sides with adhesives holding the first and second flexible materials to the glass pieces 12.

In this embodiment it is required to form a three dimensional shape, however, the V-grooves between glass pieces occur first on one side and then on the other. The glass pieces 12 are arranged side by side and where there is to be a fold, a cut is made in the flexible material with a razor blade on the side opposite to the flexible material to fold. Thus as shown in FIG. 13, cuts are made in the flexible material 10 for folds 72 and cuts are made in the flexible material 68 for folds 70. When the composite is folded to the desired shape, the bonding agent 16 is placed in the appropriate V-groove which when cured forms the rigid three dimensional composite shape.

If it is necessary to repair an existing composite, then one or more broken glass pieces may be cut out. It has been found that a thin lateral cutting bit used with an electric engraving or craving tool cuts through the cured bonding material so the broken glass piece may be removed. A replacement glass piece is then cut, shaped to take the position that the broken piece was removed from, and ensuring that there is sufficient space or gap between the edges of the new glass piece and the space in the composite. A sheet or strips of flexible material is adhesively attached to one side of the composite, to cover the position that the broken piece was removed from and also a marginal portion of all adjacent glass surfaces of the composite. The replacement glass piece is positioned and adhesively attached to the flexible material. Bonding agent is then used either with a putty knife or other suitable means of application. The bonding agent sticks not only to the glass but also to any existing bonding agent. Excess bonding agent can be removed and the seams around the new glass piece allowed to cure. When the bonding agent has cured, the flexible material is removed. This process can be applied to two dimensional and three dimensional composites while in their installed position. The putty like bonding agent may be inserted into the gaps or seams either vertically or horizontal as it sticks in place, and furthermore a metallic coating or other type of covering may be used on the top of the bonding agent after it has cured. The repair process above described may also be used on composites assembled using know methods such as copper foil and lead came.

Various changes may be made to the embodiments shown herein without departing from the scope of the present invention which is limited only by the following claims.

The embodiments of the present invention in which an exclusive property or privilege is claimed are defined as follows:

1. A method of constructing a substantially self supporting composite of separate glass pieces comprising the steps of:

arranging a plurality of individual precut glass pieces with uncovered edges in a pattern with flexible material adhering to surfaces of adjacent glass pieces;

providing gaps between the glass pieces to expose edges of adjacent glass pieces, and applying an epoxy resin bonding agent in putty-like form in the gaps to rigidly bond the edges between the adjacent glass pieces but not to overlap onto the surfaces of the adjacent glass pieces.

2. The method of constructing a composite of glass pieces according to claim 1 wherein the glass pieces are flat and the pattern is on a substantially flat plane.

3. The method of constructing a composite of glass pieces according to claim 1 wherein the flexible material is removed from the surfaces of adjacent glass pieces after the bonding agent is cured to leave the composite of glass pieces.

4. The method of constructing a composite of glass pieces according to claim 1 wherein the composite is subtantially two dimensional and the gaps between the glass pieces are in the range of about $\frac{1}{8}$ to $\frac{1}{4}$ of an inch.

5. The method of constructing a composite of glass pieces according to claim 1 wherein the composite is substantially three dimensional and the glass pieces are arranged on the flexible material in a flat plane with edges touching so the gaps are substantially eliminated, folded at the eliminated gaps into a desired shape to form V-grooves and the bonding agent applied to the V-grooves.

6. The method of constructing a composite of glass pieces according to claim 1 wherein the composite is substantially three dimensional and the glass pieces are arranged on the flexible material in a flat plane with the gaps between edges being in the range of about 1/32 to $\frac{1}{8}$ of an inch, folded at the gaps into a desired shape to form V-grooves, and the bonding agent applied to the V-grooves.

7. The method of constructing a composite of glass pieces according to claim 1 wherein the flexible material comprises strips adhering to surfaces of adjacent glass pieces.

8. The method of constructing a composite of glass pieces according to claim 1 wherein the flexible material comprises a sheet extending under the pattern and one surface of each of the glass pieces adhering to the sheet.

9. The method of constructing a composite of glass pieces according to claim 1 wherein a metallic powder is placed on the surface of the bonding agent in the gaps prior to the bonding agent curing to provide a metallic finish.

10. The method of constructing a composite of glass pieces according to claim 1 wherein a color tint is added to the bonding agent to provide a tinted finish on the surface of the bonding agent in the gaps.

11. The method of constructing a composite of glass pieces according to claim 1 wherein the surface of the bonding agent in the gaps is crowned.

12. The method of constructing a composite of glass pieces according to claim 1 wherein the surface of the bonding agent in the gaps is substantially flat.

13. The method of constructing a composite of glass pieces according to claim 12 including the addition of an adhesive lead tape applied on top of the bonding agent in the gaps.

14. The method of constructing a composite of glass pieces according to claim 1 wherein the bonding agent is tinted prior to application.

15. The method of constructing a composite of glass pieces according to claim 1 wherein powdered metal is added to the bonding agent prior to application.

16. A composite of glass pieces made according to the method of claim 1.

17. A method of constructing a composite of glass pieces comprising the steps of:

placing a precut flat glass panel on a sheet of flexible material in a substantially flat plane with one surface of the glass panel adhering to the sheet, scoring the glass panel to form a series of scored straight lines in the form of a pattern thereon, breaking the glass panel at the scored lines to provide individual glass pieces on the sheet, folding the sheet between the glass pieces to a desired three dimensional shape to provide V-grooves between adjacent glass pieces, filling the V-grooves with an epoxy resin bonding agent in putty-like form to rigidly bond edges between adjacent glass pieces, ensuring the bonding agent does not overlap the surfaces of the adjacent pieces, and allowing the bonding agent to cure.

18. The method of constructing a composite of glass pieces according to claim 17 wherein the sheet is wrapped around a form after breaking the glass panel at the scored lines.

19. The method of constructing a composite of glass pieces according to claim 17 wherein a sheet is attached to both surfaces of the glass pieces and the sheet attached to one surface is cut along the gap and the sheet attached to the other surface is folded to form a V-groove.

20. A composite of glass pieces made according to the method of claim 17.

* * * * *